US012215912B2

(12) United States Patent
Gormley et al.

(10) Patent No.: US 12,215,912 B2
(45) Date of Patent: Feb. 4, 2025

(54) CONTAINER LID

(71) Applicant: Starbucks Corporation, Seattle, WA (US)

(72) Inventors: Joseph E. Gormley, Mercer Island, WA (US); Zander J. Hall-Spicuzza, Mountlake Terrace, WA (US); Caleb R. Mattox, Issaquah, WA (US)

(73) Assignee: Starbucks Corporation, Seattle, WA (US)

( * ) Notice: Subject to any disclaimer, the term of this patent is extended or adjusted under 35 U.S.C. 154(b) by 154 days.

(21) Appl. No.: 18/054,861

(22) Filed: Nov. 11, 2022

(65) Prior Publication Data

US 2024/0159442 A1 May 16, 2024

(51) Int. Cl.

| | |
|---|---|
| ***F25C 5/20*** | (2018.01) |
| ***B65D 43/16*** | (2006.01) |
| ***B65D 43/20*** | (2006.01) |

(52) U.S. Cl.

CPC ..... *F25C 5/24* (2018.01); *B65D 43/163* (2013.01); *B65D 43/20* (2013.01)

(58) Field of Classification Search

CPC ..... F25C 5/24; B65D 43/20; B65D 1/63

USPC ..... 141/248, 284; 49/61–63; 406/120

See application file for complete search history.

(56) References Cited

U.S. PATENT DOCUMENTS

| | | | | |
|---|---|---|---|---|
| 5,354,152 | A * | 10/1994 | Reinhardt | B65G 53/60 406/182 |
| 5,622,457 | A * | 4/1997 | Thiele | B65G 53/56 406/182 |
| 6,167,711 | B1 | 1/2001 | Slattery et al. | |
| 6,439,428 | B1 * | 8/2002 | Schroeder | F25C 5/24 222/64 |
| 10,094,608 | B2 | 10/2018 | Ouzts | |

FOREIGN PATENT DOCUMENTS

| | | |
|---|---|---|
| CN | 113959146 A | 1/2022 |

* cited by examiner

*Primary Examiner* — Timothy L Maust

(74) *Attorney, Agent, or Firm* — Knobbe, Martens, Olson & Bear, LLP

(57) ABSTRACT

Disclosed herein are methods of ice dispensing and ice dispensing devices and systems. Example devices and systems described herein can include a container lid that includes a first cover portion that defines an opening disposed through a portion of the first cover portion, the first portion having an inner edge and an outer edge. Devices and systems can include a second cover portion that defines opening disposed through a portion of the second cover portion having an inner edge and outer edge opposite the inner edge, the opening extending from an inner edge of the second cover portion, wherein the second cover portion is movably coupled to the first cover portion to at least partially overlap with the first cover portion. Devices and systems can further include a door movably coupled to the second cover portion, wherein the door is movably disposable over the opening of the second cover portion.

25 Claims, 7 Drawing Sheets

CONTAINER LID

FIELD

The present disclosure relates to systems and methods for storing and dispensing beverage components such as ice, and in certain embodiments, a container lid for a dispensing system that can store and deliver ice.

BACKGROUND

Beverages at a coffee store can require ice to be dispensed in a serving area. A relatively larger amount of ice can be stored remotely from the serving area and used to refill ice stored in the serving area. Conventionally ice can be moved between the remote area and the serving area. Customer demand can be increasingly high, and efficiency can become increasingly more important in beverage preparation. The locations of ice and storage equipment need to be efficiently configured. Storing the ice and equipment in a way that is practical and accessible for use and for refilling can also be challenging, especially at large scales.

SUMMARY

The systems, methods and devices of this disclosure each have several innovative aspects, no single one of which is solely responsible for the desirable attributes disclosed herein.

In certain examples a container lid can comprise a first cover portion that defines an opening disposed through a portion of the first cover portion. The first portion can have an inner edge and an outer edge. The container lid can comprise a second cover portion that defines an opening disposed through a portion of the second cover portion having an inner edge and outer edge opposite the inner edge. The opening can extend from an inner edge of the second cover portion, wherein the second cover portion is movably coupled to the first cover portion to at least partially overlap with the first cover portion. The container lid can comprise a door movably coupled to the second cover portion, wherein the door is movably disposable over the opening of the second cover portion. The container lid is disposable in an open configuration such that the opening of the first cover portion and the opening of the second cover portion at least partially overlap and the door is disposed in a retracted position. The container lid is disposable in a closed configuration wherein the opening of the first cover portion and the opening of the second cover portion do not overlap and the door is disposed in an extended position over the opening of the second cover portion.

In certain examples, the door is slidably coupled to the second cover portion. In certain examples, the door is rotatably coupled to the second cover portion. In certain examples the container lid comprises a duct adapter comprising cylindrical inner surface that defines an opening, wherein the duct adapter is coupled to the first cover portion such that the duct adapter forms an extended channel with the opening of the first cover portion. In certain examples, the duct adapter is positioned to abut at least a portion of the door wherein the door moves into the retracted position as the container lid moves from the closed configuration to the open configuration. In certain examples, the door further comprises a door surface and a protrusion that extends at least partially perpendicular to the door surface wherein the protrusion is substantially rigidly coupled to the door surface such that movement of the protrusion causes movement of the door surface. In certain examples, the protrusion is positioned to interfere with at least one other portion of the container lid such that the door moves into the retracted position when the container lid moves from the closed configuration to the open configuration. In certain examples, the protrusion is positioned to interfere with at least one other portion of the container lid such that the door moves into the extended position when the container lid moves from the open configuration to the closed configuration In certain examples, the opening of the second cover portion is a u-shaped cutout that extends from an inner edge of the second cover portion toward an outer edge of the second cover portion. In certain examples, the first cover portion comprises a protrusion positioned to interfere with at least a portion of the door such that the door moves into the extended position when the container lid moves from the closed configuration to the open configuration. In certain examples, the second cover portion further comprises a cover surface and a handle at least partially rigidly coupled to the cover surface, wherein movement of the handle moves the second cover portion with respect to the first cover portion. In certain examples, the container lid further comprises one or more stoppers disposed on an inner edge of the second cover portion, wherein the stoppers are configured to abut a portion of the first cover portion when the lid is in the open configuration, and wherein the stoppers are positioned to limit movement of the inner edge of the second cover portion toward the first cover portion such that the opening of the second cover portion and the opening of the first cover portion are aligned when the container lid is in the open configuration.

Certain examples of the disclosure can include a dispensing system comprising a duct having an inlet and an outlet, a source container coupled to the inlet of the duct, and a dispensing container comprising an enclosure and an opening adjacent the outlet of the duct, wherein the outlet of the duct is in communication with the opening of the dispensing container. The dispensing system can also include a container lid comprising an opening adjacent the outlet of the duct, wherein outlet of the duct and the opening of the dispensing container are in communication with the opening of the container lid, wherein the container lid is movably coupled to the receiving and disposable between an open position and a closed position, wherein in the open position the container lid is not disposed over at least a portion of the opening of the dispensing container and wherein in the closed position the container lid is disposed over the opening of the dispensing container, and wherein the duct is in communication with the dispensing container when the container lid is in the open position and when the container lid is disposed in the closed position.

In certain examples, the door is slidably coupled to the second cover portion. In certain examples, the door is rotatably coupled to the second cover portion. In certain examples, the container lid comprises a first cover portion that defines an opening disposed through a portion of the first cover portion, the first portion having an inner edge and an outer edge. The container lid can comprise a second cover portion that defines opening disposed through a portion of the second cover portion, the second cover portion having an inner edge and outer edge opposite the inner edge, the opening extending from an inner edge of the second cover portion, wherein the second cover portion is movably coupled to the first cover portion to at least partially overlap with the first cover portion The container lid can comprise a door movably coupled to the second cover portion, wherein the door is movably disposable over the opening of the second cover portion, wherein the container lid is disposable in an open configuration such that the opening of the first cover portion and the opening of the second cover portion at least partially overlap and the door is disposed in a retracted position, and wherein the container lid is disposable in a closed configuration wherein the opening of the first cover portion and the opening of the second cover portion do not overlap and the door is disposed in an extended position over the opening of the second cover portion. In certain examples, the lid further comprises a duct adapter comprising cylindrical inner surface that defines an opening, wherein the duct adapter is coupled to the first cover portion such that the duct adapter forms an extended channel with the opening of the first cover portion and the duct. In certain examples, the duct adaptor is positioned to abut at least a portion of the door wherein the door moves into the retracted position as the container lid moves from the closed configuration to the open configuration. In certain examples, the system includes an ice propeller comprising a motor and a rotatable shovel disposed at least partially in the source container, wherein the ice propeller is configured to move ice from the source container into the duct. In certain examples, the dispensing container is an insulated container. In certain examples, the system includes a gate disposed about at least a portion of the opening of the dispensing container, wherein the gate is movably disposable between the opening of the dispensing container and the duct.

Certain examples of the disclosure can include a method of dispensing ice. The method can comprise an outer container lid to move between an open configuration and a closed configuration, wherein the container lid comprises a first cover portion, a second cover portion, and a door, wherein in the closed configuration an opening of the first cover portion and an opening of the second cover portion are not aligned, and the door is disposed in an extended position over the opening of the second cover portion, and wherein in the open configuration the opening of a second cover portion and the opening of a first cover portion of the lid are at least partially aligned and a door is disposed in a retracted position that does not positioned over the opening of the second cover portion. In certain examples, the method can further comprise causing ice to be expelled from an ice source through a duct and into a dispensing container. In certain examples, causing the container lid to move into the open configuration comprises causing a door to move into a retracted position. In certain examples, causing the container lid to move into the closed configuration comprises causing the door to move into an extended configuration.

Figure 1:
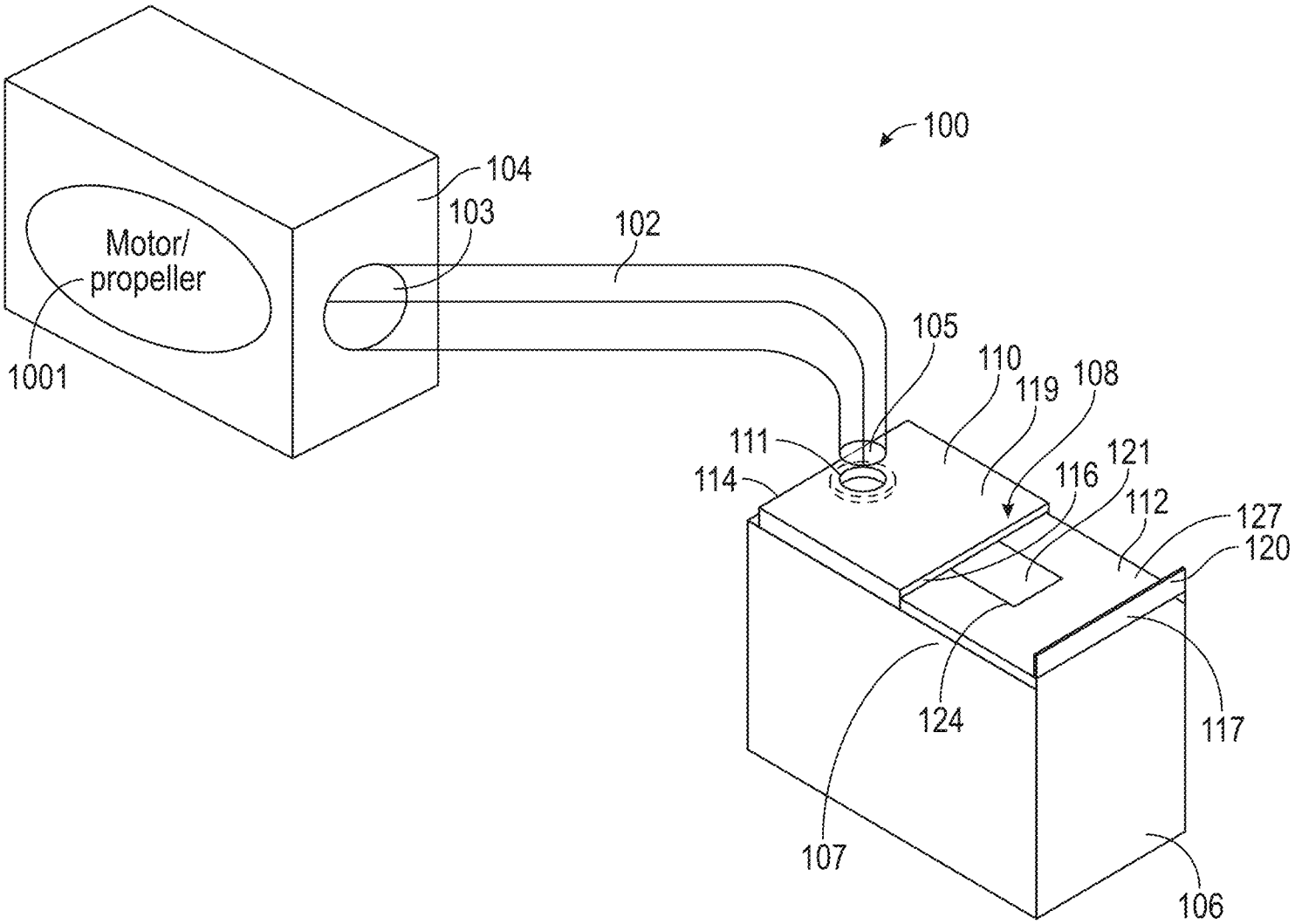
FIG. 1 illustrates an embodiment of a dispensing system.

Various embodiments are depicted in the accompanying drawings for illustrative purposes and should in no way be interpreted as limiting the scope of the embodiments. Furthermore, various features of different disclosed embodiments can be combined to form additional embodiments, which are part of this disclosure.

DETAILED DESCRIPTION

Various ice storage and dispensing systems and methods are described below to illustrate various examples that may achieve one or more desired improvements. These examples are only illustrative and not intended in any way to restrict the general disclosure presented and the various aspects and features of this disclosure. The general principles described herein may be applied to embodiments and applications other than those discussed herein without departing from the spirit and scope of the disclosure. Indeed, this disclosure is not limited to the particular embodiments shown but is instead to be accorded the widest scope consistent with the principles and features that are disclosed or suggested herein. For example, while the container lid embodiments are described in the context of an ice container it should be appreciated that certain aspect and features of the disclosed embodiments can be use in contains used to store other types of materials.

Conventionally, ice can be stored in at least two locations in a store, beverage preparation location or restaurant. For example, ice can be stored in a source container in a storage section of the restaurant and also stored in a dispensing container at a location in the store remote from the source container, and where the ice may be served to customers. Conventionally, ice in the dispensing container is refilled by carrying ice from the source container to the dispensing container in a third container. The ice is often carried by a user such as a restaurant operator. The user carries the third container to the source container, opens the source container, scoops ice from the source container with the third container, travels to the dispensing container, opens the dispensing container and pours the ice from the third container into the dispensing container. This process can require significant time and can cause waste due to ice spillage and/or melting of the ice during transit.

To solve such problems, a system can be provided that uses a transfer duct to transfer ice between the source container and the dispensing container. As such, the source container dispenses ice from the source container, through the transfer duct and into the dispensing container. In such instances, the dispensing container can have an opening on a top side of the container, where ice from the transfer duct is disbursed into the dispensing container. However, in such an arrangement, the transfer duct is in consistent communication with the source container and the dispensing container. This is often achieved by using an at least partially open design such that the portion of the dispensing container that receives the ice is not covered. Existing sliding lids designs are not feasible for continuous distribution of ice into the dispensing container, as the sliding lid may cover an opening of the dispensing container when the dispensing container is in the open position, as a portion of the lid that may form a sliding door would cover the opening that would receive the ice.

To address these or other concerns, disclosed herein is a dispensing system 100 which is described initially with respect to FIG. 1. The dispensing system provides a path between a source container 104 and a dispensing container 106 such that items such as ice, can be transferred directly from the source container 104 to the dispensing container 106 without requiring an additional container or requiring a person to manually pull items such as ice from the source container 104 to the dispensing container 106. The system provides a motorized and/or gravity fed system that causes ice to be removed from the source container 104 and transported to the dispensing container 106 through a duct 102. The system further provides a container lid 108 that allows the dispensing container 106 to continuously receive ice from the source container 104 while a sliding door is used to cover the dispensing container 106 and provide temporary access to the interior of the dispensing container 106. The system provides a mechanism to allow the dispensing container 106 to receive ice from the source container 104 regardless of whether the lid 108 is in an open configuration or the closed configuration. As such, the dispensing system can accommodate continuous ice filling in the dispensing container 106 in ergonomically restrictive spaces (e.g., under a counter).

With continued reference to FIG. 1, the duct 102 provides an enclosed channel between the source container 104 and the dispensing container 106. The duct 102 can connect a plurality of containers such that objects can be moved between containers through the duct 102 without the direct intervention of a user. The duct 102 can provide a low-friction surface such that the duct 102 facilitates smooth gravitationally fed transfer of objects between containers. The duct 102 includes an inlet 103, an outlet 105, and a duct body that extends between the inlet and the outlet 105 of the duct 102 and defining a channel. The channel is configured to receive solid items (such as ice) and allow the solid items to pass therethrough. The duct 102 can be a flexible duct such that the duct 102 can be routed through portions of a building such as a restaurant so that the inlet 103 and the outlet 105 can be disposed in locations remote from each other. In the example shown in FIG. 1, the duct 102 has a circular cross section, but in other examples, the duct 102 can have other cross section shapes suitable to allow solid objects such as cubed ice or crushed ice to pass therethrough (e.g., square cross section or rectangular cross section). The duct 102 can be positioned such that an inlet 103 of the duct 102 can be disposed at a location further from the ground than the outlet 105 of the duct 102. As such, the duct 102 can be configured to support gravity fed transportation of objects therethrough. In some examples, the duct 102 is flexible, but in other examples the duct 102 is rigid. In some examples the duct 102 is at least partially transparent, but in other examples, the duct 102 is not transparent. In some examples, the duct 102 can have a diameter from about 0.5 in. to about 3 in., the duct 102 can have a length up to about 75 ft. In some examples, the dispensing system 100 does not include a duct 102, and the source container 104 is in direct communication with the container lid 108. In some examples the duct 102 has a continuous diameter, and in other examples, the diameter of the duct 102 increases and/or decreases along the length of the duct 102. The duct 102 can be formed from a material that allows objects to pass therethrough with relatively low friction. For example, the duct 102 can be made from any food safe material. For example, in some examples, the duct 102 can be made from a polymer, stainless steel or aluminum.

With continued reference to FIG. 1, the source container 104 is provided to hold objects such as ice that can be distributed through the duct 102. In some examples, the source container 104 is an insulated container, provided to maintain a temperature of objects such as ice that are stored therein. The source container 104 includes a container body having an inner surface defining an inner volume and at least partially encloses objects held in the source container 104. The source container 104 includes an inlet provided to receive objects into the enclosure, the source container 104 also includes an outlet provided to allow objects to pass out of the source container 104 and into the duct 102. The inlet can be a door, or a continuous opening that allows objects to be put into the inner volume of the source container 104. The inlet can have an opening with a width about 12-48 in. and a length about 12-36 in. The outlet can be a door or a continuous opening that allows to pass out of the inner volume of the source container 104. The outlet can have a cross sectional area from about 0.5 sq in., to about 30 sq in. The container body can include single layer of material surrounding the inner volume, or a plurality of layers surrounding the inner volume. The source container 104 can have an inner volume from about 5 cu ft to about 40 cu ft. In some examples, the container is formed from polyethylene. In some examples, the source container 104 can include an insulated material such as high-density polyurethane-based foam that surrounds at least a portion of the inner volume. The outlet of the container is adjacent the inlet 103 of the duct 102 such that items let out of the outlet are ejected into the duct 102.

The source container 104 can include an ice propeller therein 1001 that includes a motor 1004 and a rotatable shovel to push items such as ice through the outlet and out of the source container 104. In some examples, the motor 1004 is an electric motor is coupled to a shovel. The shovel is provided to push ice toward the outlet of the source container 104 as the motor 1004 spins. In other examples, the items are drawn out of the outlet by gravity. In such examples, the outlet can be disposed closer to the ground than other portions of the source container forming a ramp that allows the objects to slide through the outlet and out of the container toward the duct 102. In some examples, the source container, can include a door (e.g., a rotating door or a sliding door) disposed about the outlet of the source container 104. In some other examples, the source container 104 does not include a door and the outlet of the source container 104 is in substantially continuous direct communication with the inlet 103 of the duct 102.

As shown in FIG. 1, The dispensing container 106 is provided to hold objects such as ice that have been distributed through the duct 102. In some examples, the dispensing container 106 is an insulated container, provided to maintain a temperature of objects such as ice that are stored therein. The dispensing container 106 includes a container body having an inner surface defining an inner volume and at least partially encloses objects held in the dispensing container 106. The dispensing container 106 includes an opening that forms a mouth of the dispensing container 106. The dispensing container has an opening 107 where at least a portion of the lid 108 can be disposed. The lid 108 can have a stationary portion or first portion that has an inlet opening 111 through which the duct can be positioned. The opening 111 can be positioned such that the duct 102 extends through the inlet in the lid such that the outlet 105 of the duct 102 extends below the lid and into the dispensing container. The opening is provided to receive objects into the enclosure. For example, the opening can be in fluidic communication with the outlet 105 of the duct 102, such that items passing out of the outlet 105 of the duct 102 can pass into the opening of the container. The opening 107 is further provided to allow objects to be removed from the dispensing container 106. For example, ice can be scooped out of the dispensing container 106 through the opening. The opening 107 can have a cross sectional area from about 1 cu ft to about 30 cubic feet. In some examples, a gate 109 is disposed about a portion of the opening 107, such that the gate can movably close and open independent of the lid 108 to allow or restrict communication between the duct 102 and the dispensing container 106. For example, the gate 109 can be a slidable door or a rotatable door disposed about the opening 107 of the dispensing container 106.

The dispensing container 106 can further include connectors to interface with a sliding container door, such as rails surrounding at least a portion of the outlet of the duct 102. In some examples, the container lid 108 can connect to the rails and slide along the rails. In some examples, the container body of the dispensing container 106 can include single layer of material surrounding the inner volume, or a plurality of layers surrounding the inner volume. The dispensing container 106 can have an inner volume from about 1 cu ft to about 30 cu ft). In some examples, the dispensing container 106 is formed from stainless steel. In some examples, the dispensing container 106 can include an insulated material such as high-density polyurethane-based foam that surrounds at least a portion of the inner volume.

The container lid 108 provides a cover for opening 107 of the dispensing container 106. The container lid 108 can be opened in an ergonomically confined space without blocking the inlet that receives ice from the source container. The container lid 108 is further provided to couple to the dispensing container 106 such that an opening in the container lid 108 is adjacent the of the duct 102. The opening of the container lid 108 is provided to allow the dispensing container 106 to be in communication with the opening of the container lid 108 and the channel of the duct 102. As such, the container lid 108 is not disposed over at least a portion of the opening of the dispensing container 106 during operation. As such, the duct 102 remains in communication with the dispensing container 106 when the container lid 108 is in the open position and when the container lid 108 is disposed in the closed position.

Figure 2:
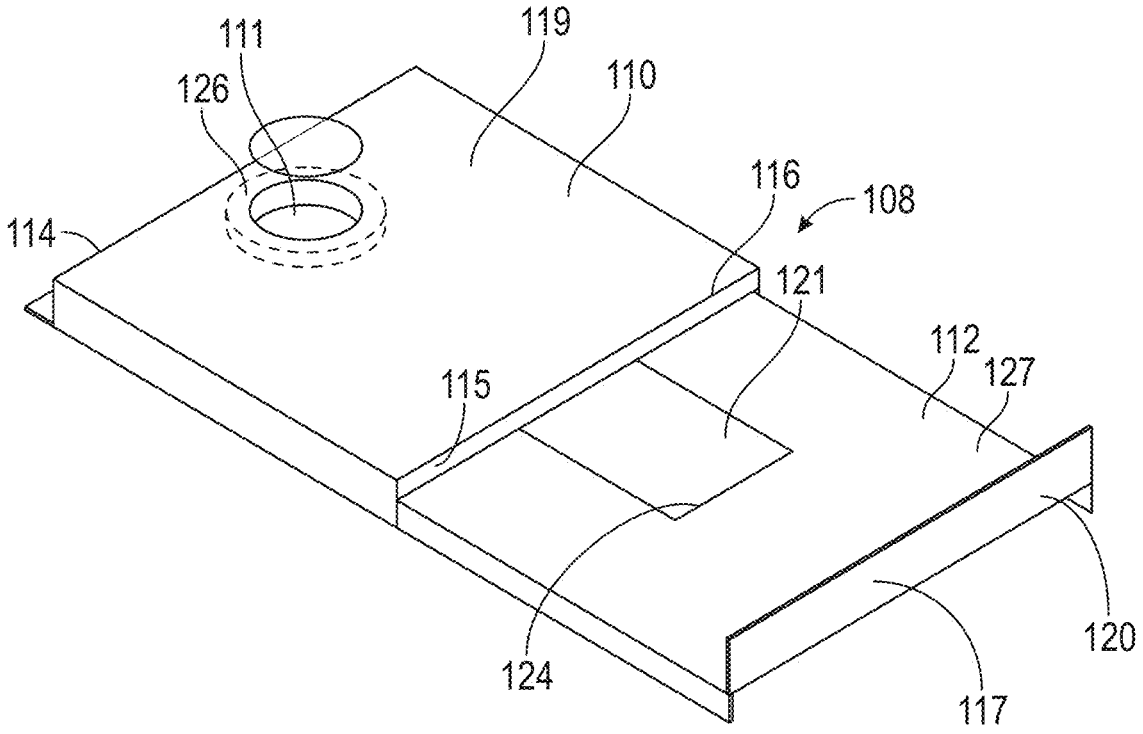
FIG. 2 illustrates a top perspective view of a container lid of the dispensing system shown in FIG. 1 in a closed configuration.

With reference now to FIG. 2, The container lid 108 includes a first cover portion 110, a second cover portion 112 coupled to the first cover portion 110, a door 121 coupled to the second cover portion 112 and a duct adapter 126 coupled to the first cover portion 110.

The first cover portion 110 provides a fixed cover for a portion of the opening of dispensing container 106. The first cover portion 110 further provides a base for the container lid 108 to move relative to itself. The first cover portion 110 includes an inner edge 114, an outer edge 116 opposite and spaced apart from the inner edge, and a cover body 119 that extends between the inner edge 114 and the outer edge 116. The cover body 119 of the first cover portion 110 defines the opening 111 that extends through at least part of the first cover portion 110. In some examples, such as the example shown in FIGS. 1-4, the first cover portion 110 can include a protrusion 115 that extends along the outer edge 116 of the first cover portion 110 and extends perpendicular to the cover body of the first cover portion 110. The protrusion 115 is provided to abut a portion of a door 121 (described below) of the second cover portion 112 such as a protrusion of the door 121. In some examples, the first cover portion 110 includes rails 125 (shown in FIGS. 3-4 and described in more detail below) that extend at least partially between the inner edge 114 and the outer edge 116 of the first cover portion 110. The rails 125 are configured to receive at least a portion of the second cover portion 112 and provide a surface to slide against the second cover portion 112.

In some examples, such as the in the example shown in FIGS. 1-4, the lengths of the edges of the first cover portion 110 can be the same, or the length of the inner edge 114 can be greater or smaller than the length of the outer edge 116. The lengths of the edges of the first cover portion 110 can be selected to correspond with the size of at least one edge of the opening of the dispensing container 106. The first cover portion 110 can have an edge length (first cover portion width) from about 12 in. to about 36 in. The protrusion 115 can be formed from rigid food safe materials.

As shown in FIGS. 1-4, the second cover portion 112 is provided to be a door that covers a portion of a container such as the dispensing container 106 and can be moved back and forth with respect to the first cover portion 110 between a closed position and an open position to provide access to the interior of the dispensing container 106. The second cover portion 112 includes an inner edge 118 and an outer edge 120 opposite and spaced apart from the inner edge 118, and a cover body 127 that includes at least one cover surface and that extends between the inner edge 118 and the outer edge 120. The cover body 127 of the second cover portion 112 includes cut-out edges that define a cut-out opening 113. In some examples, such as the example shown in FIGS. 1-4, the cover body 127 of the second cover portion 112 has a u-shaped cut out edge that defines a u-shaped opening which extends from the inner edge 118 of the second cover portion 112.

In some examples, such as the example shown in FIGS. 1-4, the second cover portion 112 further includes a handle 117 (see e.g., FIG. 1) at least partially rigidly coupled to the cover surface such that movement of the handle 117 slidably moves the second cover portion 112 with respect to the first cover portion 110. The handle 117 shown in FIGS. 1-4 is a protrusion that extends from the outer edge 120 of the second cover portion 112. But in other examples, the handle can be other suitable handles such as a knob or an arch shaped handle. The handle can be separately formed from the second cover portion 112 or integrally formed with the second cover portion 112.

In some examples, such as the in the example shown in FIGS. 1-4, the lengths of the edges of the second cover portion 112 can be the same, or the length of the inner edge 118 can be different from the length of the outer edge 120. The lengths of the edges of the second cover portion 112 can be selected to correspond with the size of at least one edge of the opening of the dispensing container 106. The second cover portion 112 can have an edge length (second cover portion width) from about 12 in. to about 36 in. The protrusion 123 can be formed from rigid food safe materials.

Figure 5:
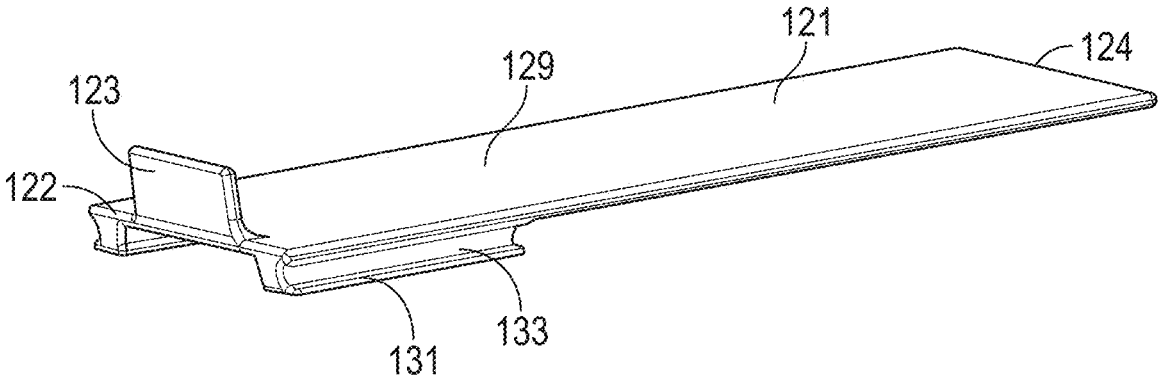
FIG. 5 illustrates a door of the container lid shown in FIG. 2.

FIG. 5 shows a detailed view of an example of the door 121. The door 121 is provided to cover the cut-out 113 of the second cover portion 112 when the container lid 108 is in the closed configuration. The door 121 includes an inner edge 122, an outer edge 124 opposite and spaced apart from the inner edge 121, and a door body 129 that extends between the inner edge 120 and the outer edge 124. The door 121 includes rails 131 that define channels 133 that extend along at least a portion of the door 121 between the inner edge 120 and the outer edge 124 of the door 121. The channels 133 are couplable to the second cover portion 112 such that the channels 133 of the door 121 extend over either side of at least a portion of the cut-out edges such that the door 121 is slidably coupled to the second cover portion 112 and slidably disposable over the cut-out 113 of the second cover portion 112. The door 121 is disposable in an extended position where the door 121 covers substantially all of the cut-out 113 of the second cover portion 112. The door 121 is also slidably disposable in a retracted position where the door 121 does not cover at least a portion of the cut-out 113 of the second cover portion 112.

The door 121 includes the protrusion 123 that extends from the door body 129 in a direction perpendicular to the door body 129. The protrusion 123 provides a stop that abuts at least a portion of the container lid 108 such that the door 121 slides independently from other portions of the container lid 108. The protrusion 123 can be uniformly formed from the same material as the door body 129, as shown in FIG. 5. But in other examples, the protrusion 123 can be an attachment formed from the same material as the door body 129 or another material. The door body 129 and protrusion 123 can be formed from rigid food safe materials.

In some examples, the protrusion 115 of the first cover portion 110 abuts the door 121 such that the door 121 can be slidably moved with respect to the second cover portion 112 as the door 121 moves between the open configuration and the closed configuration. For example, at least a portion of the door 121 can abut the protrusion 115 of the first cover portion 110 when the second cover portion 112 is being moved to the closed configuration. Additionally, the door 121 is moved to an extended position as the second cover portion 112 is being moved to the closed configuration.

In some examples, the container lid 108 is disposable in the open configuration such that the opening 111 of the first cover portion 110 and the cut-out 113 of the second cover portion 112 at least partially overlap. In the open configuration, the door 121 is disposed in a retracted position. The container lid 108 is further disposable in the closed configuration wherein the opening 111 of the first cover portion 110 and the cut-out 113 of the second cover portion 112 do not overlap and the door 121 is disposed in an extended position over the cut-out 113 of the second cover portion 112.

In the closed configuration the opening 111 of the first cover portion 110 and the cut-out 113 of the second cover portion 112 are not aligned, and the door 121 is disposed in an extended position over the cut-out 113 of the second cover portion 112. In the closed configuration the cut-out 113 of the second cover portion 112 and the opening 111 of the first cover portion 110 of the lid are at least partially aligned and the door 121 is disposed in the retracted position, which does not extend over at least a portion of the dispensing container 106.

Figure 6:
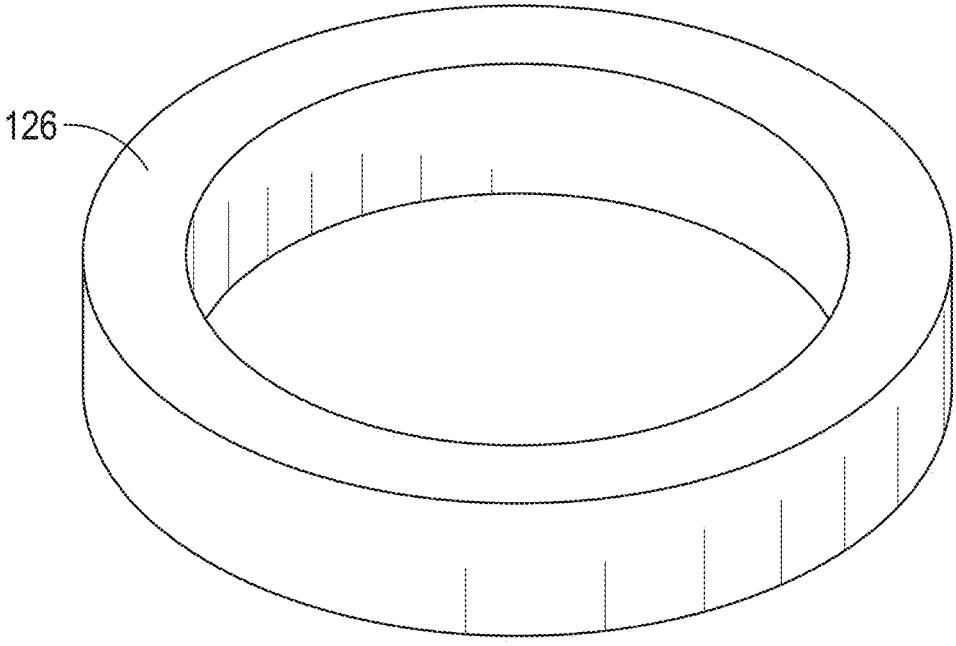

FIG. 6 shows a detailed view of an example of the duct adapter 126. The duct adapter 126 provides a stop for the door 121 and provides an additional passage to further direct objects ejected from the duct 102. The duct adapter 126 is couplable to the first cover portion 110 such that the duct adapter 126 forms an extended channel with the opening 111 of the first cover portion 110. For example, as shown in FIGS. 1-4, the duct adapter 126 is coupled flush to the body 119 of the first cover portion 110. The duct adapter 126 can protrude from a side of the first cover portion 110 on which the door 121 is located. As such, the duct adapter 126 can abut a portion of the door 121 such as the protrusion 123 of the door 121, causing the door 121 to slide along the second cover portion 112 into the retracted position. As the door 121 is moved into the retracted position, the door 121 does not obstruct the opening 111 of the first cover portion 110 as the second cover portion 112 is collapsed into the first cover portion 110. In some examples, the container lid 108 includes a duct adapter 126 having a cylinder body that includes cylindrical inner surface that defines an opening. In some examples, the diameter of the opening of the duct adapter 126 is about the diameter of the opening 111 of the first cover portion 110, although in other examples, the diameter of the opening of the duct adapter 126 is greater or smaller than the diameter of the opening of the first cover portion 110. In some examples, the inner surface of the duct adapter 126 has a uniform diameter along an axial length of the duct adapter 126. In other examples, the diameter of the duct adapter 126 varies along the axial length of the duct adapter 126. The duct adapter 126 can have a diameter from about 0.5 in. to about 6 in.

Figure 3:
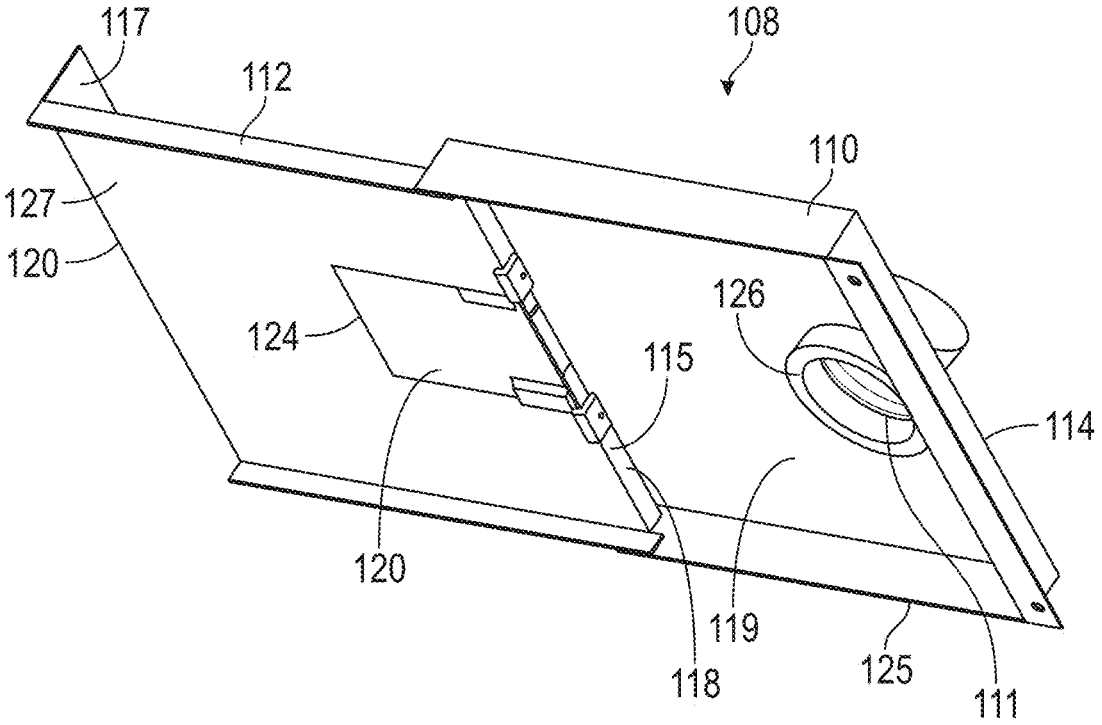
FIG. 3 illustrates a bottom top perspective view of a container lid shown in FIG. 2. in the closed configuration.
Figure 4:
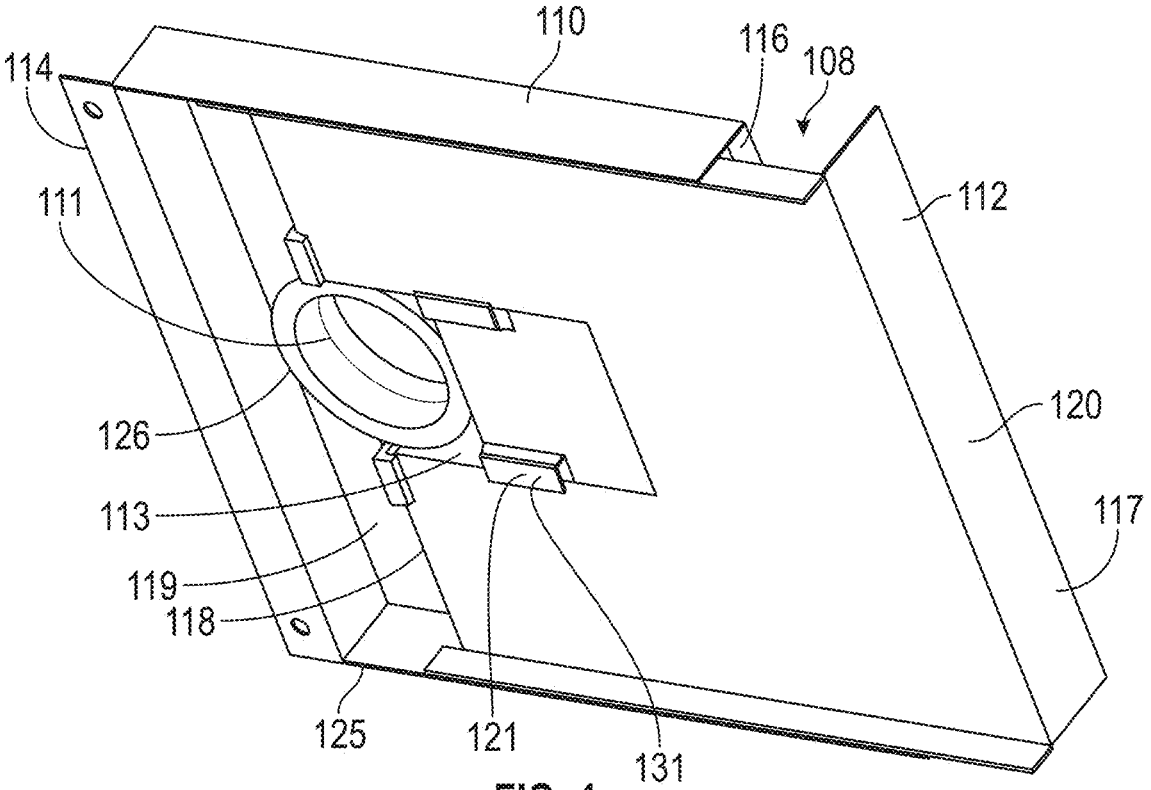
FIG. 4 illustrates a bottom top perspective view of a container lid shown in FIG. 2 in an open configuration.
Figure 7:
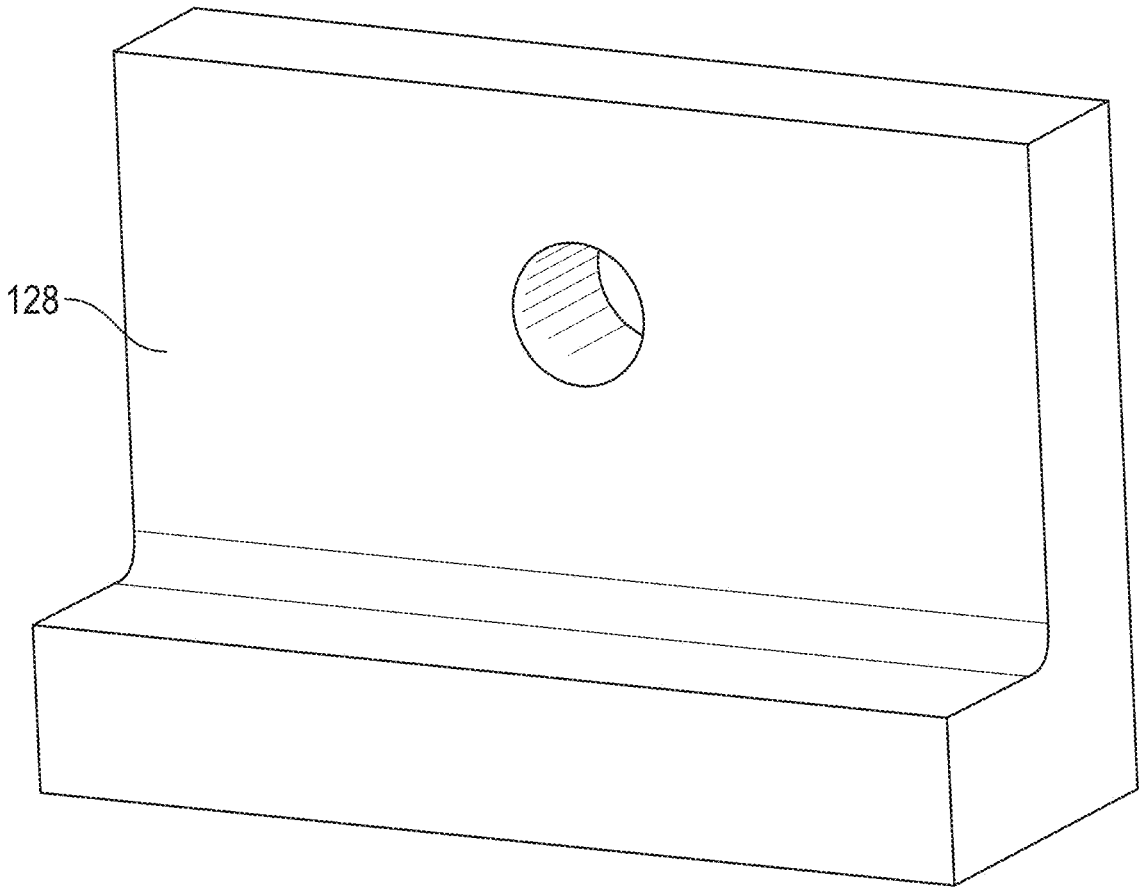
FIG. 7 illustrates a duct adapter of the container lid shown in FIG. 2.

FIG. 7 shows a stopper 128 for the second cover portion 112 of the container lid 108. As shown in FIG. 3, the stoppers 128 are provided to retain the door 121 from sliding past the inner edge 118 of the second cover portion 112. The stoppers 128 can protrude adjacent a portion of the cut-out 113 to abut the door 121 when the door 121 reaches the extended position. The stoppers 128 are further provided to space the inner edge 114 of the first cover portion 110 from the inner edge 114 of the second cover portion 112 such that the u-shaped cut out is aligned with the opening 111 of the first cover portion 110 to provide a continuous opening from the duct 102 to the dispensing container 106. The stoppers 128 can limit movement of the inner edge 114 of the second cover portion 112 toward the first cover portion 110 such that the cut-out 113 of the second cover portion 112 and the opening 111 of the first cover portion 110 are aligned when the container lid 108 is in the open configuration. As such, the stoppers 128 are configured to abut a portion of the first cover portion 110 when the lid is in the open configuration. The stopper 128 is couplable to the inner edge of the second portion of the container lid 108. The container lid 108 can further include a plurality of stoppers 128 disposed on the inner edge of the second cover portion 112 as shown in FIGS. 3-4. In some examples, such as the example shown in FIGS. 3-4 and 7, the stoppers 128 can have an L-shaped cross section such that one surface of the stopper 128 is substantially perpendicular to the body 127 of the second cover portion 112 while another surface is parallel the body 127 of the second cover portion 112 when the stopper 128 is coupled to the inner edge of the first cover portion 110.

The second cover portion 112 can be configured to move between the open position as shown in FIG. 4 and the closed position as shown in FIGS. 1-3. When in the open position, a portion of the second cover portion 112 overlaps at least a portion of the first cover portion 110. When in the closed position a smaller portion of the second cover portion 112 overlaps the first cover portion 110. As the second cover portion 112 moves from the closed position to the open position, a portion of the cut-out 113 extends around the duct adapter 126. As the cut-out 113 extends around the duct adapter 126, the door 121 abuts at least a portion of the duct adapter 126 such that the door 121 does not extend past the duct adapter 126 toward the inner edge 114 of the first cover portion 110 (and into the opening 111) as the cut-out 113 extends toward the inner edge 114 of the first cover portion 110. As such, the second cover portion 112 is collapsed into the first cover portion 110 without obstructing the opening 111 of the first cover portion 110.

As the second cover portion 112 moves from the open position to the closed position, the cut out is moved away from the opening towards the outer edge 116 of the first cover portion 110 such that the cut-out 113 does not extend around the adapter 126. The protrusion 123 of the door 121 can then abut the protrusion 115 of the first cover portion 110 such that the door extends to the extended position and covers the cut-out 113 of the first cover portion 110. The door 121 thereby completely covers the opening 107 of the dispensing container 106 in conjunction with the second cover portion 112.

Figure 8A:
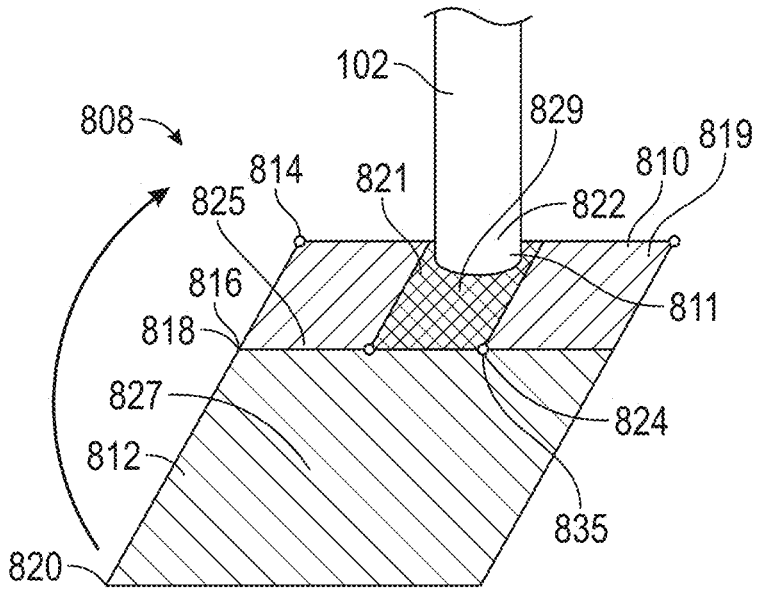
FIG. 8A illustrates an embodiment of a container lid having a door in a closed configuration.
Figure 8B:
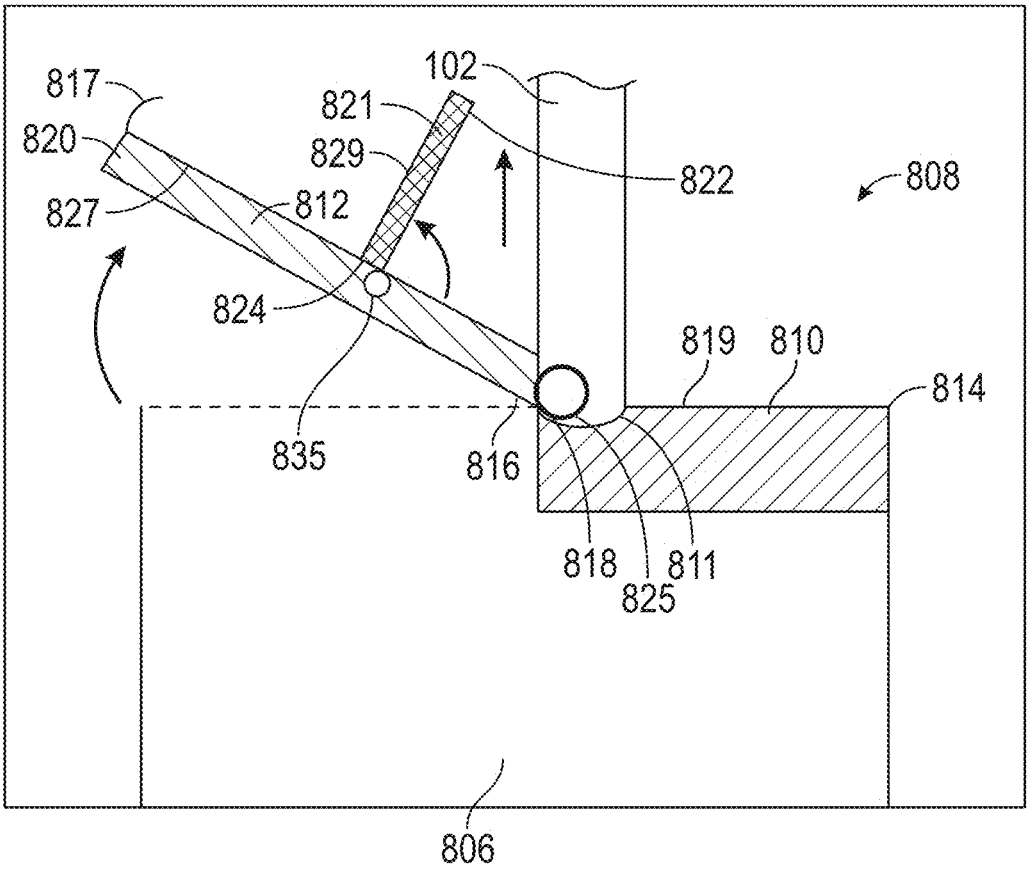
FIG. 8B illustrates an embodiment of a container lid having a door in an open configuration.
Figure 9:
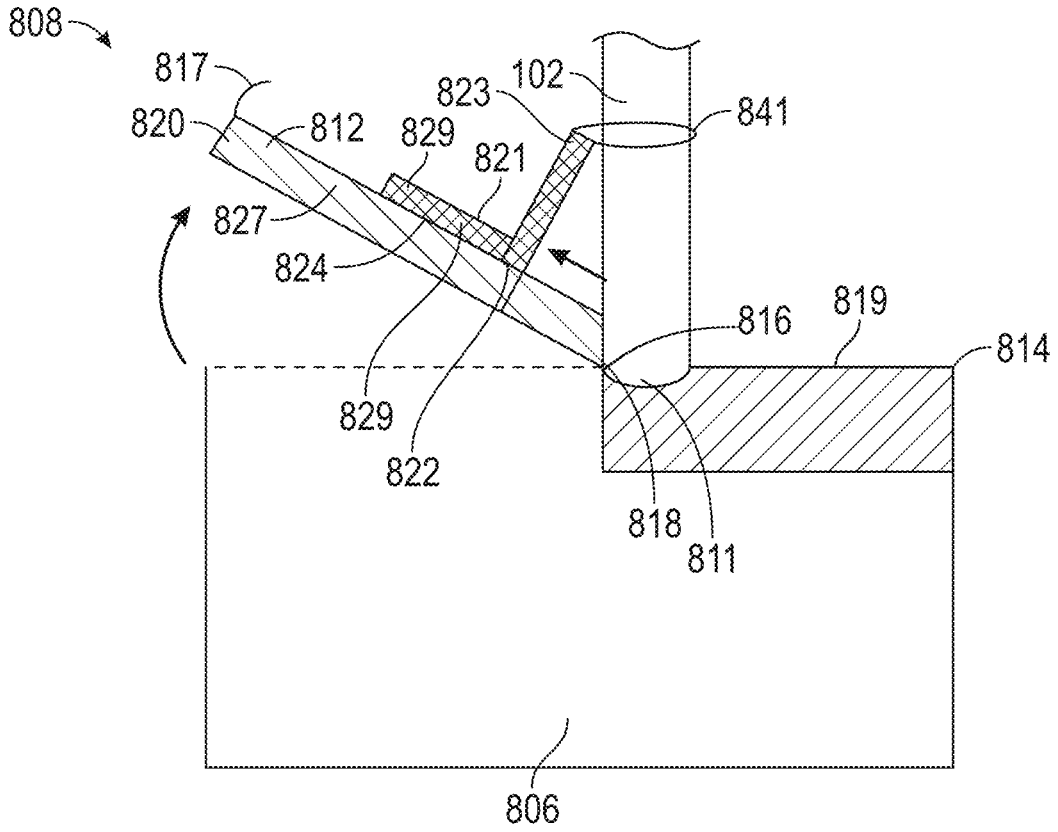
FIG. 9 illustrates an embodiment of a container lid having a door in an open configuration.

FIGS. 8A-9 show additional examples of a container lid 808 that opens by rotating open and having a compact design such that the door can pass on either side of the duct 102 when the container lid 808 rotates open. With reference now to FIGS. 8A-9, the container lid 808 includes a first cover portion 810, a second cover portion 812 coupled to the first cover portion 810, and a door 821 coupled to the second cover portion 812. In some examples such as the examples shown in FIGS. 8A-9, the duct 102 can be coupled to the first cover portion 810 such that the duct 102 would restrict the container lid 808 from opening. As such, a door 821 on the container lid 808 can be slidably or rotatably coupled to the second portion 812 of the container lid 808, such that the door 821 is pushed open as the remaining parts of the second portion 812 of the container lid 808 are moved to either side of the duct 102. In other examples, a portion of the door 812 can be coupled to a retainer 841 that is disposed about the duct 102. In such examples including the retainer 841, as the door 821 is opened, the retainer 841 slides up the duct 102 with the retainer 841 and the door 821 is also translated outward with respect to the second cover portion 812.

As shown in FIGS. 8A-8B, the first cover portion 810 provides a fixed cover for a portion of the opening of dispensing container 106. The first cover portion 810 further provides a base for the container lid 808 to move relative to itself. The first cover portion 810 includes an inner edge 814, an outer edge 816 opposite and spaced apart from the inner edge 814, and a cover body 819 that extends between the inner edge 814 and the outer edge 816. The cover body 819 of the first cover portion 110 defines an opening 811 that extends through at least part of the first cover portion 810. In some examples, the first cover portion 810 includes at least a portion of set of rotational coupling mechanisms 825 such as hinges or rotatable wheels that can be disposed opposite each other on either side of the cover body 819 of the first cover portion 810 between the inner edge 814 and the outer edge of the first cover portion 810. The rotational coupling mechanisms 825 are configured to receive at least a portion of the second cover portion 812 and provide an interface by which to rotate the second cover portion 812.

In some examples, such as the in the example shown in FIGS. 8A-9, the lengths of the edges of the first cover portion 810 can be the same, or the length of the inner edge 814 can be greater or smaller than the length of the outer edge 816. The lengths of the edges of the first cover portion 810 can be selected to correspond with the size of at least one edge of the opening of the dispensing container 806. The first cover portion 810 can have an edge length (first cover portion width) from about 12 in. to about 36 in.

As shown in FIGS. 8A-9, the second cover portion 812 is provided to be a door that covers a portion of a container such as the dispensing container 806 and can be moved rotationally with respect to the first cover portion 810 between a closed position and an open position to provide access to the interior of the dispensing container 806. The second cover portion 812 includes an inner edge 818 and an outer edge 820 opposite and spaced apart from the inner edge 818, and a cover body 827 that includes at least one cover surface and that extends between the inner edge 818 and the outer edge 820. The cover body 827 of the second cover portion 812 includes cut-out edges that define a cut-out opening (not shown). In some examples, such as the example shown in FIGS. 8A-9, the cover body 827 of the second cover portion 812 has a u-shaped cut out edge that defines a u-shaped opening which extends from the inner edge 818 of the second cover portion 812.

In some examples, such as the example shown in FIGS. 8A-9, the second cover portion 812 further includes a handle 817 (see e.g., FIGS. 8A-9) at least partially rigidly coupled to a surface of the second cover portion 810 such that movement of the handle 817 rotatably moves the second cover portion 812 with respect to the first cover portion 810. The handle 817 shown in FIGS. 8A-9 is a protrusion that extends from the outer edge 820 of the second cover portion 812. But in other examples, the handle can be other suitable handles such as a knob or an arch shaped handle. The handle 817 can be separately formed from the second cover portion 812 or integrally formed with the second cover portion 812.

In some examples, such as the in the example shown in FIGS. 8A-9, the lengths of the edges of the second cover portion 812 can be the same, or the length of the inner edge 818 can be different from the length of the outer edge 820. The lengths of the edges of the second cover portion 812 can be selected to correspond with the size of at least one edge of the opening of the dispensing container 806. The second cover portion 812 can have an edge length (second cover portion width) from about 12 in. to about 36 in.

In the examples shown in FIGS. 8A-9, the door 821 is provided to cover the cut-out of the second cover portion 812 when the container lid 808 is in the closed configuration. The door 821 includes an inner edge 822, an outer edge 824 opposite and spaced apart from the inner edge 821, and a door body 829 that extends between the inner edge 820 and the outer edge 824.

In some examples, such as the example shown in FIG. 8, the door 821 includes at least a portion of a set of rotational coupling mechanisms 835 such as hinges that can be disposed opposite each other on either side of the door body 829 about the outer edge 824 of the door 821. At least a portion of the coupling mechanisms 835 can be coupled to the second cover portion 810 between the inner edge 822 and the outer edge 824 of the first cover portion 810. The rotational coupling mechanisms 835 are configured to provide an interface through which to rotate the door 821 with respect to the second cover portion 812.

In the example shown in FIG. 8, the duct 102 can abut the door 821 such that the door 821 can be rotatably moved with respect to the second cover portion 812 as the door 821 moves between the open configuration and the closed configuration. For example, at least a portion of the door 821 can be disposed at a non-perpendicular angle with the duct 102 such that the door 821 can slide along a length of the duct 102 when the second cover portion 812 is being moved to the open configuration. Additionally, the door 821 can slide down a length of the duct 102 and fall to a closed position as the second cover portion 812 is being moved to the closed configuration.

In some examples such as the example shown in FIG. 9, the door 821 includes rails (not shown) substantially similar to the rails shown in FIGS. 3-5. The rails define channels that extend along at least a portion of the door 821 between the inner edge 820 and the outer edge 824 of the door 821. The channels are couplable to the second cover portion 812 such that the channels of the door 821 extend over either side of at least a portion of the cut-out edges such that the door 821 is slidably coupled to the second cover portion 812 and slidably disposable over the cut-out of the second cover portion 812. The door 821 is disposable in a closed position where the door 821 covers substantially all of the cut-out of the second cover portion 812. The door 821 is also rotatably disposable in an opened position (described in further detail below) where the door 821 does not cover at least a portion of the cut-out of the second cover portion 812.

In some examples such as the example shown in FIG. 9, the door 821 includes a protrusion 823 that extends from the door body 829 in a direction perpendicular to the door body 829 about the inner edge 822 of the door 821. The protrusion 823 provides an interface to abut the at least a portion of the duct 102 such that the door 821 slides independently from other portions of the container lid 808 as the door 821 is pushed into the duct 102 due to rotation of the second cover portion 812 into the open position. In some examples, the protrusion 823 can be uniformly formed from the same material as the door body 829, as shown in FIG. 9. But in other examples, the protrusion 823 can be an attachment formed from the same material as the door body 829 or another material. The door body 829 and protrusion 823 can be formed from rigid food safe materials.

In the example shown in FIG. 9, the container lid 808 includes a retainer 841. The retainer 841 is provided to guide the door 821 along a length of the duct 102 as the door 821 is translated in an axial direction along the duct 821. In the example shown in FIG. 9, the retainer 841 is a retaining ring that defines an opening to accept the duct 102. But in other examples, the retainer can be square shaped, or any other shape that provides an opening suitable to accept the duct 102 therethrough. The duct 102 is disposed in the opening of the retainer 841 such that the retainer 841 can slide along the length of the duct 102. A portion of the retainer 841 can be coupled to the protrusion 815 of the door 821 such that the door 821 rotates with respect to the retainer 841 as the angle of the door 821 changes with respect to the duct 102. The door 821 can be slidably moved with respect to the second cover portion 812 at least partially via force between the retainer 841 and the duct 102 as the door 821 moves between the open configuration and the closed configuration.

In some examples as shown in FIGS. 8B and 9, the container lid 808 is disposable in the open configuration such that the second cover portion 812 is disposed at an angle with the first cover portion 810 such that the first cover portion 810 and the second cover portion 812 form an angle less than 180 degrees with respect to each other. In the open configuration, the door 821 is disposed in a retracted or open position. The container lid 808 is further disposable in the closed configuration wherein the duct 102 and the cut-out of the second cover portion 812 do not overlap and the door 821 is disposed in an extended or closed position over the opening 811 of the second cover portion 812.

In the closed configuration, the opening of the first cover portion 810 and a substantial portion of the cut-out of the second cover portion 812 are not laterally overlapping in a plane substantially parallel to the first inner edge 818 and the outer edge 820 of the second cover portion 812. In the closed configuration the door 821 is also disposed in the closed position over the opening of the second cover portion 812. In the closed configuration the cut-out of the second cover portion 812 and the opening 811 of the first cover portion 810 of the lid are at least partially aligned and the door 821 is disposed in the retracted position, which does not extend over at least a portion of the dispensing container 806.

Figure 10:
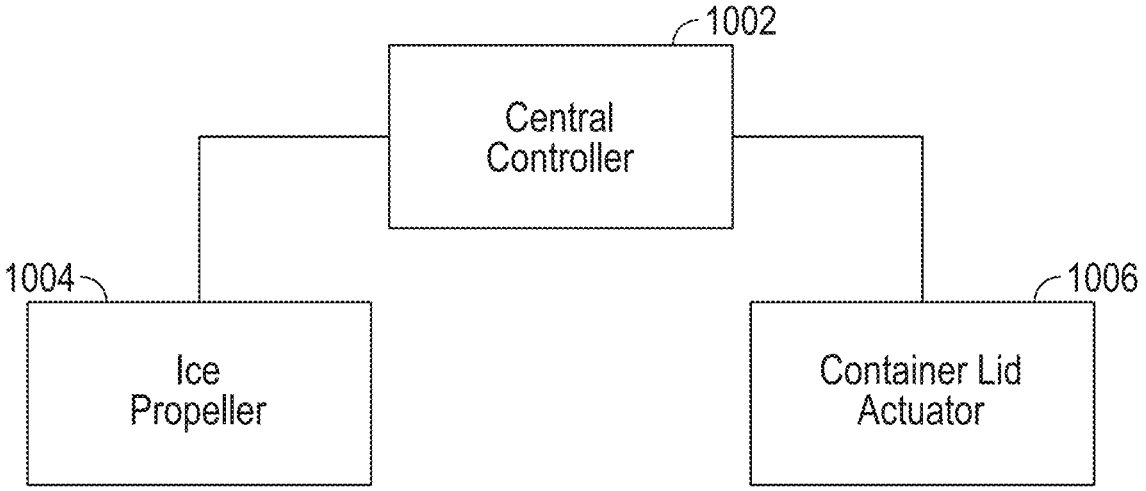
FIG. 10 illustrates a schematic of a controller, a motor, and an actuator for the dispensing system shown in FIG. 1.

FIG. 10 shows a schematic representation of a controller 1002 communicatively coupled to the ice propeller motor 1004 and a container lid actuator 1006. The controller 1002 provides for automation of ice distribution and at least partially automates the process of drawing ice from the source container and drawing ice out of the dispensing container 106. The automation of the ice distribution through the controller 1002 provides for synchronization with other activities related to ice distribution such as drink preparation and customer demand. In some examples, the controller 1002 is in electrical communication with the motor of the ice propeller 1001. As such, the controller 1002 can control the rotation of the motor such that the speed and frequency of the rotation provides continuous or optimized periodic dispersion of ice through the outlet of the source container 104 based at least in part on factors such as beverage preparation needs and/or customer demand. In some examples, the actuator (e.g., a servo motor) is coupled to the second cover portion 112 such that the door can be moved between the extended and retracted positions by the servo upon receiving instructions from the controller 1002 to move the second cover portion 112. In some examples, the opening and closing of the lid can be performed by a user and at least partially automated by the actuator 1006 and the controller 1002. For example, the controller can send instructions to the actuator to close the container lid 108 over the dispensing container 106 causing the second cover portion 112 to move between the open configuration and the closed configuration.

The controller can be an electronic central controller that includes a processor and computer executable instructions to coordinate functions form beverage preparation such as functions of the motor 1004 and the actuator 1006. The controller can be used to optimize throughput of ice dispensation by indicating optimal times and rates for initiation of ice dispensing utility functions and thereby providing minimal waiting periods between functions. The controller can be electrically communicatively coupled to the motor in the source container 104 and an actuator coupled to the container lid 108.

As shown in FIG. 10, the controller 1002 is communicatively coupled to motor 1004 and the actuator 1006. The controller 1002 is configured to send electrical signals to the first motor 1004 and the actuator 1006 such that the motor 1004 and the actuator 1006 can be activated/initiated or deactivated by the controller 1002.

The controller 1002 can be configured to cause the first motor 1004 to perform the at least one ice dispensing routine and cause the actuator to perform the at least one beverage lid opening routine. For example, the controller 1002 can cause the motor to dispense ice from the source container 104 and cause the actuator 1006 to open the container lid 108

The controller 1002 can be configured to receive signals from a plurality of sensors and control mechanisms disposed about the dispensing system 100. For example, the containers 104, 106 may include at least one thermometer to determine the temperature of ice, scales to determine weight of ice in the container 104, 106 container such as a pitcher, a timer to monitor the amount of time elapsed since ice has been dispensed, or any other control mechanism that can provide signals to indicate information regarding a status of a process to make dispense ice. The controller 1002 can also be configured to receive signals from a thermometer, a scale, a timer, or any other control mechanism that can provide signals to indicate information regarding a status of a process to dispense ice.

The controller 1002 can further coordinate the preparation of drinks based on ice dispensing routines. In some examples, ice dispensing routines can include predetermined preparation timing such that ice is dispensed in sequence with the opening of the container lid 108. In some examples, the controller 1002 includes data transmission components such as Wi-Fi, ethernet, Bluetooth, ZigBee, or any other suitable network connection to transmit data to a remote location. For example, the controller 1002 can transmit data to a remote neural network, which can use the transmitted data to determine one or more likely ice dispensing routines. The controller 1002 can be further configured to receive information through the data transmission components from the neural network. The controller 1002 can be further configured to alter the ice dispensing routines of dispensing systems based on data received from a remote location such as the remote neural network.

Conditional language used herein, such as, among others, "can," "might," "may," "e.g.," and the like, unless specifically stated otherwise, or otherwise understood within the context as used, is generally intended to convey that some embodiments include, while other embodiments do not include, certain features, elements, and/or states. Thus, such conditional language is not generally intended to imply that features, elements, blocks, and/or states are in any way required for one or more embodiments or that one or more embodiments necessarily include logic for deciding, with or without author input or prompting, whether these features, elements and/or states are included or are to be performed in any particular embodiment.

Depending on the embodiment, certain acts, events, or functions of any of the processes or algorithms described herein can be performed in a different sequence, can be added, merged, or left out altogether (e.g., not all described operations or events are necessary for the practice of the algorithm). Moreover, in certain embodiments, operations or events can be performed concurrently.

The various illustrative schematics, motors, actuators, routines, and algorithm steps described in connection with the embodiments disclosed herein can be implemented as electronic hardware, computer software, or combinations of both. To clearly illustrate this interchangeability of hardware and software, various illustrative components, blocks, modular dispensers, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

Moreover, the various illustrative schematics, devices, and systems in connection with the embodiments disclosed herein can be implemented or performed by a machine, such as a general purpose processor device, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor device can be a microprocessor, but in the alternative, the processor device can be a controller, microcontroller, or state machine, combinations of the same, or the like. A processor device can include electrical circuitry configured to process computer-executable instructions. In another embodiment, a processor device includes an FPGA or other programmable device that performs logic operations without processing computer-executable instructions. A processor device can also be implemented as a combination of computing devices, e.g., a combination of a DSP and a microprocessor, a plurality of microprocessors, one or more microprocessors in conjunction with a DSP core, or any other such configuration. Although described herein primarily with respect to digital technology, a processor device may also include primarily analog components. For example, some or all of the signal processing algorithms described herein may be implemented in analog circuitry or mixed analog and digital circuitry. A computing environment can include any type of computer system, including, but not limited to, a computer system based on a microprocessor, a mainframe computer, a digital signal processor, a portable computing device, a device controller, or a computational engine within an appliance, to name a few.

The elements of a method, process, routine, or algorithm described in connection with the embodiments disclosed herein can be embodied directly in hardware, in a software module executed by a processor device, or in a combination of the two. A software module can reside in RAM memory, flash memory, ROM memory, EPROM memory, EEPROM memory, registers, hard disk, a removable disk, a CD-ROM, or any other form of a non-transitory computer-readable storage medium. An exemplary storage medium can be coupled to the processor device such that the processor device can read information from, and write information to, the storage medium. In the alternative, the storage medium can be integral to the processor device. The processor device and the storage medium can reside in an ASIC. The ASIC can reside in a user terminal. In the alternative, the processor device and the storage medium can reside as discrete components in a user terminal.

While the above detailed description has shown, described, and pointed out novel features as applied to various embodiments, it can be understood that various omissions, substitutions, and changes in the form and details of the devices or algorithms illustrated can be made without departing from the spirit of the disclosure. For example, although different numbers have been used for similar components or features in different figures (e.g., different numbers have been used for the dispenser modules, displays, controllers, etc.), the structural and functional features described in connection with one figure, embodiment, or numbered element may be incorporated into the different-numbered components or features, and vice-versa. As can be recognized, certain embodiments described herein can be embodied within a form that does not provide all of the features and benefits set forth herein, as some features can be used or practiced separately from others. The scope of certain embodiments disclosed herein is indicated by the appended claims rather than by the foregoing description. All changes which come within the meaning and range of equivalency of the claims are to be embraced within their scope.

What is claimed is:

1. A dispensing system comprising:

a duct having an inlet and an outlet;

a source container coupled to the inlet of the duct;

a dispensing container comprising an enclosure and an opening adjacent the outlet of the duct, wherein the outlet of the duct is in communication with the opening of the dispensing container; and a container lid comprising an opening adjacent the outlet of the duct, wherein outlet of the duct and the opening of the dispensing container are in communication with the opening of the container lid, wherein the container lid is movably coupled to the dispensing container and disposable between an open position and a closed position, wherein in the open position the container lid is not disposed over at least a portion of the opening of the dispensing container and wherein in the closed position the container lid is disposed over the opening of the dispensing container, and wherein the duct is in communication with the dispensing container when the container lid is in the open position and when the container lid is disposed in the closed position.

2. The system of claim 1, wherein the container lid comprises a first cover portion that defines the opening in the container lid in communication with the outlet of the duct, the opening disposed through a portion of the first cover portion, the first portion having an inner edge and an outer edge, a second cover portion that defines a second opening disposed through a portion of the second cover portion, the second cover portion having an inner edge and outer edge opposite the inner edge, the second opening extending from an inner edge of the second cover portion, wherein the second cover portion is movably coupled to the first cover portion to at least partially overlap with the first cover portion; and a door movably coupled to the second cover portion, wherein the door is movably disposable over the second opening of the second cover portion, wherein when the container lid is in the open position the opening of the first cover portion and the second opening of the second cover portion at least partially overlap and the door is disposed in a retracted position, and wherein when the container lid is in the closed position the opening of the first cover portion and the opening of the second cover portion do not overlap and the door is disposed in an extended position over the opening of the second cover portion.

3. The system of claim 2, wherein the door is slidably coupled to the second cover portion.

4. The system of claim 2, wherein the door is rotatably coupled to the second cover portion.

5. The system of claim 2, wherein the container lid further comprises a duct adapter comprising cylindrical inner surface that defines an opening, wherein the duct adapter is coupled to the first cover portion such that the duct adapter forms an extended channel with the opening of the first cover portion and the duct.

6. The system of claim 5, wherein the duct adapter is positioned to abut at least a portion of the door wherein the door moves into the retracted position as the container lid moves from the closed position to the open position.

7. The system of claim 1, further comprising an ice propeller comprising a motor and a rotatable shovel disposed at least partially in the source container, wherein the ice propeller is configured to move ice from the source container into the duct.

8. The system of claim 1, wherein the dispensing container is an insulated container.

9. The system of claim 1, further comprising a gate disposed about at least a portion of the opening of the dispensing container, wherein the gate is movably disposable between the opening of the dispensing container and the duct.

10. The system of claim 1, wherein the container lid comprises a first portion, a second portion, and a third portion.

11. The system of claim 10, wherein the second portion is slidably coupled to the first portion, and the third portion is slidably coupled to the second portion.

12. The system of claim 10, wherein the second portion and the third portion are configured to slidably move between the open position and the closed position.

13. The system of claim 12, wherein the second portion is configured to slidably move into the first portion to move from the closed position to the open position.

14. The system of claim 12, wherein the first portion is a stationary portion of the container lid.

15. The system of claim 12, wherein the second portion comprises a handle, wherein movement of the handle moves the second portion between the open position and the closed position.

16. The system of claim 12, wherein the container lid comprises stoppers configured to limit movement of the second portion toward the first portion.

17. The system of claim 12, wherein the first portion comprises the opening of the container lid, and wherein the second portion and the third portion do not cover the opening of the container lid when the container lid is in the open position.

18. The system of claim 17, wherein the container lid further comprises a duct adaptor coupled to the first portion such that the duct adaptor forms an extended channel with the opening of the container lid and the duct.

19. The system of claim 1, wherein an interior of the dispensing container is accessible through the opening of the dispensing container when the container lid is in the open position.

20. The system of claim 1, wherein an interior of the dispensing container is not accessible through the opening of the dispensing container when the container lid is in the closed position.

21. The system of claim 1, wherein the source container is configured to distribute ice to the dispensing container through the duct.

22. A method of dispensing ice with a dispensing system comprising a duct having an inlet, a source container coupled to an inlet of the duct, and a dispensing container comprising an enclosure and an opening adjacent an outlet of the duct, the method comprising:

causing an outer container lid movably coupled to the dispensing container to move between an open configuration and a closed configuration, the outer container lid comprising an opening adjacent the outlet of the duct, wherein the outlet of the duct is in communication with the opening of the dispensing container when the container lid is in the open configuration and when the container lid is in the closed configuration, wherein in the closed configuration the outer container lid is disposed over an opening of the dispensing container, and wherein in the open configuration the container lid is not disposed over at least a portion of the opening of the dispensing container.

23. The method of claim 22, further comprising causing ice to be expelled from the source container through the duct and into the dispensing container.

24. The method of claim 22, wherein causing the container lid to move into the open configuration comprises causing a door to move into a retracted position.

25. The method of claim 22, wherein causing the container lid to move into the closed configuration comprises causing a door to move into an extended configuration.

* * * * *